US011335231B2

(12) United States Patent
Chang

(10) Patent No.: US 11,335,231 B2
(45) **Date of Patent: *May 17, 2022**

(54) DATA CONVERSION CIRCUIT FOR CONVERTING BLACK-AND-WHITE OR GRAYSCALE FRAMES FOR COLOR DISPLAY PANEL/ MODULE, AND ELECTRONIC DEVICE AND COLOR DISPLAY DEVICE USING THE SAME

(71) Applicant: Mars Semiconductor Corp., Hsinchu (TW)

(72) Inventor: Yi-Shing Chang, Hsinchu (TW)

(73) Assignee: Mars Semiconductor Corp., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/090,836

(22) Filed: Nov. 5, 2020

(65) Prior Publication Data

US 2021/0390896 A1 Dec. 16, 2021

Related U.S. Application Data

(63) Continuation-in-part of application No. 16/903,025, filed on Jun. 16, 2020, now abandoned.

(51) Int. Cl.
*G09G 3/20* (2006.01)
*G09G 3/36* (2006.01)

(52) U.S. Cl.
CPC ..... *G09G 3/2003* (2013.01); *G09G 3/36* (2013.01); *G09G 2320/0666* (2013.01)

(58) Field of Classification Search
CPC .. G09G 3/3607; G09G 3/3688; G09G 3/2003; G09G 3/36; G09G 2320/0666
See application file for complete search history.

(56) References Cited

U.S. PATENT DOCUMENTS 9,323,103 B2 * 4/2016 Mori ..... G09G 3/3607

* cited by examiner

*Primary Examiner* — Kenneth B Lee, Jr.
(74) *Attorney, Agent, or Firm* — Rosenberg, Klein & Lee

(57) ABSTRACT

A data conversion circuit for converting black-and-white or grayscale frames for a color display panel/module, and an electronic device and a color display device using the data conversion circuit are disclosed. The data conversion circuit includes a data conversion unit for receiving an input data of the black-and-white or grayscale frame provided by a controller/MCU. The data conversion unit converts the input data into a color frame data for the color display panel/module, and no input clock or reference clock for adjusting an output rate of the color frame data is received or generated by the data conversion circuit.

10 Claims, 2 Drawing Sheets

DATA CONVERSION CIRCUIT FOR CONVERTING BLACK-AND-WHITE OR GRAYSCALE FRAMES FOR COLOR DISPLAY PANEL/ MODULE, AND ELECTRONIC DEVICE AND COLOR DISPLAY DEVICE USING THE SAME

TECHNICAL FIELD

The present disclosure relates to a data conversion circuit for converting black-and-white or grayscale frames for a color display panel/module and an electronic device and a color display device using the same, more particularly, to a data conversion circuit capable of converting the black-and-white or grayscale frame from being displayed on an existing electronic device to a color display panel/module, and an electronic device and a color display device using the data conversion circuit so as to display the black-and-white or grayscale frame thereon.

BACKGROUND

Conventional electronics such as home appliances, machine tools, processing machines, watches and calculators may display information with black-and-white or grayscale pixel displays or black-and-white liquid crystal displays like seven-segment displays or black-and-white matrix liquid crystal displays. Therefore, the signals output by the conventional electronic device to the pixel display or the black-and-white liquid crystal display could be a plurality of black-and-white or grayscale pixels signals, a control signal, at least one string signal, at least one number signal, or at least one symbol signal of a frame. However, as color displays, such as color liquid crystal displays, are more common now, the production of pixel displays or black-and-white liquid crystal displays has decreased, and so the production cost of the pixel display or the black-and-white liquid crystal display is higher than that of the color display.

First, referring to FIG. 1, a conventional electronic device 1 includes a controller/MCU (microcontroller unit) 11 and a black-and-white liquid crystal display 12, wherein the controller/MCU 11 is electrically connected to the black-and-white liquid crystal display 12 and outputs control signals, number signals, string signals or symbol signals so as to control the black-and-white liquid crystal display 12 to display a black-and-white frame corresponding to the signal data. For example, the electronic device 1 can be a landline telephone device and the controller/MCU 11 controls the black-and-white liquid crystal display 12 to display number digits according to buttons that were touched or pressed. Or, the electronic device 1 can be a processing machine, and the controller/MCU 11 outputs control signals, number signals, string signals, or symbol signals to control the black-and-white liquid crystal display 12 to display black-and-white frames corresponding to the output signals. In other implementations, the black-and-white liquid crystal display 12 of the electronic device 1 is replaced by a black-and-white or grayscale pixel display, and the controller/MCU 11 outputs multiple black-and-white or grayscale pixel signals of a frame to drive the pixel display to display the black-and-white or grayscale frame corresponding to the output signals.

Next, referring to FIG. 2, a conventional color liquid crystal display 2 (one of color display panels/modules) includes a timing controller 21, a source driver 22, a gate driver 23 and a liquid crystal display panel 24, wherein the timing controller 21 is electrically connected to the source driver 22 and the gate driver 23, and the liquid crystal display panel 24 is electrically connected to the source driver 22 and the gate driver 23. The timing controller 21 receives color frame signals, wherein the resolution of the color frame signal typically corresponds to the resolution of the liquid crystal display panel 24. For instance, if the resolution of the liquid crystal display panel 24 is 1024*968*3 pixels, then the resolution of the color frame signals input to the timing controller 21 is also 1024*968*3 pixels. The timing controller 21 controls the gate driver 23 to sequentially drive multiple columns of pixel transistors in the liquid crystal display panel 24 and controls the source driver 22 to send the plurality of pixel signals to the pixel transistors in the corresponding columns.

From FIG. 1 and FIG. 2 and the description above, it is clear that due to the difference in data format, the color liquid crystal display cannot be used directly to replace the pixel display or the black-and-white liquid crystal display. Hence, when the pixel display or the black-and-white liquid crystal display of the conventional electronic device is broken or has a malfunction and needs to be replaced or changed, the technical problem arises and the cost for maintenance and repair could be higher.

SUMMARY

To solve the aforementioned issues, an object of the present disclosure is to provide a data conversion circuit for converting black-and-white or grayscale frames for a color display panel/module. The data conversion circuit includes a data conversion unit which is used to receive an input data of the black-and-white or grayscale frame provided by a controller/MCU and to generate or provide a color frame to the color display panel/module. The data conversion unit converts the input data into the color frame data, and no input clock or reference clock for adjusting an output rate of the color frame data is received or generated by the data conversion circuit.

Another object of the present disclosure is to provide a color display device having a color display panel/module and the aforementioned data conversion circuit, and yet another object of the present disclosure is to provide an electronic device having a controller/MCU and the aforementioned color display device.

Optionally, the data conversion unit is a computing unit formed by a plurality of circuit components.

Optionally, the data conversion circuit converts the gamut of the plurality of pixel signals of the black-and-white or grayscale frame from grayscale to color and generates the color frame data.

Optionally, the electronic device is a home appliance, a machine tool, a processing machine, a watch, or a calculator.

In short, the data conversion circuit disclosed by the present disclosure allows a color display panel/module to replace a black-and-white liquid crystal display or a pixel display. Moreover, the data conversion circuit can be integrated with the color display panel/module to form a color display device, or integrated with the color display panel/module and the controller/MCU to from an electronic device.

BRIEF DESCRIPTION OF THE DRAWINGS

The structure as well as preferred modes of use, further objects, and advantages of this present disclosure will be best understood by referring to the following detailed description of some illustrative embodiments in conjunction with the accompanying drawings, in which.

DETAILED DESCRIPTION OF THE PREFERRED EMBODIMENTS

Figure 1:
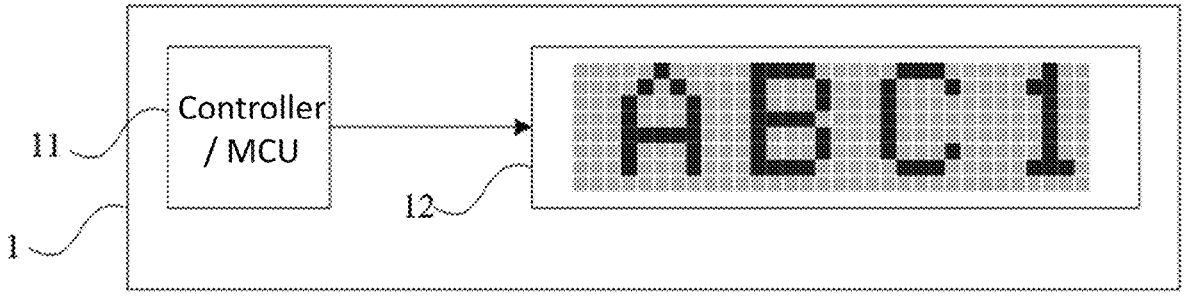
FIG. 1 (Related Art)
FIG. 1 is a block diagram of a conventional electronic device displaying a black-and-white frame using a black-and-white liquid crystal display.
Figure 2:
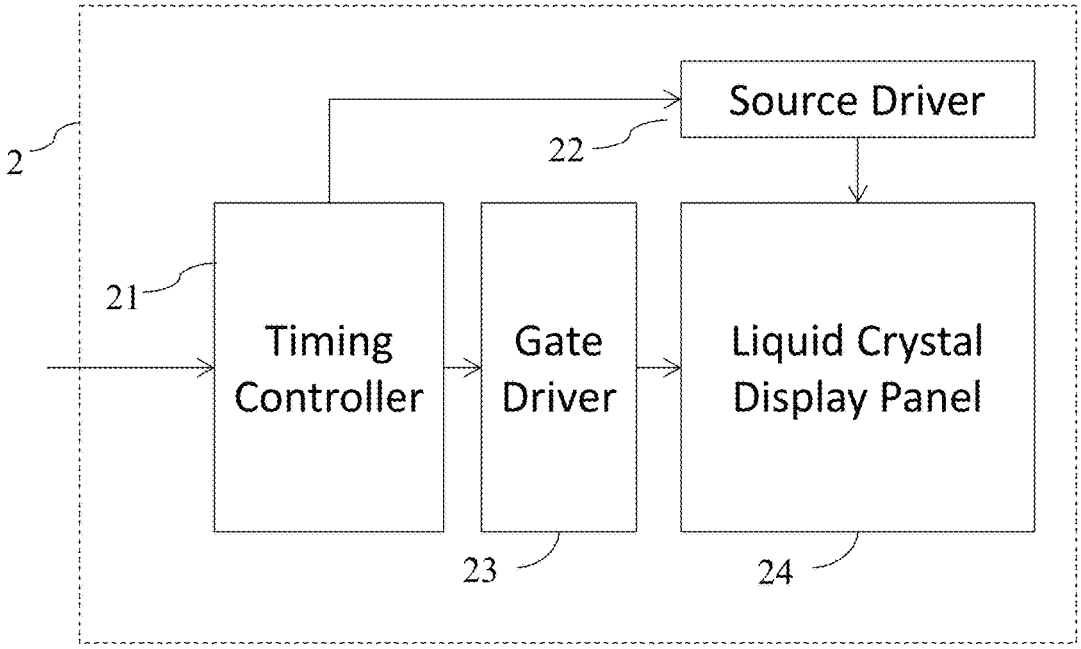
FIG. 2 (Related Art)
FIG. 2 is a block diagram of a conventional color display.

The present disclosure provides a data conversion circuit that is capable of converting black-and-white or grayscale frames displayed on a conventional electronic device into displayable frames for a color display panel/module. As such, even if the pixel display or the black-and-white liquid crystal display of the conventional electronic device is broken or has a malfunction, a current color display panel/module, like a color liquid crystal display, can be used to replace the broken or damaged pixel display or black-and-white liquid crystal display by using the data conversion circuit as an intermediary interface, and thereby effectively reducing the maintenance cost.

The input data received by the data conversion circuit is a plurality of pixel signals of a black-and-white or grayscale frame, and the data conversion circuit converts the plurality of pixel signals of the black-and-white or grayscale frame into the color frame data (for example, a transformation of color domain (gamut) from grayscale to color is performed) and provides the color frame data directly to a color display panel/module so that the color display panel/module displays a color frame corresponding to the color frame data. The data conversion circuit has no driver and so no input clock or reference clock is received or generated by the data conversion circuit, and therefore when the content of the input data sent to the data conversion circuit varies/changes, the color display panel/module changes the color frame displayed thereon by an interruptive manner.

Further, the frame refresh rate of a color display panel/module is generally at least 30 frames per second, but the output rate of the input data provided by the controller/MCU of the conventional electronic device does not correspond with the general frame refresh rate and is usually slower. Thus, a solution in the conventional technology is to generate a corresponding reference clock and increase the output rate of the color frame data to synchronize the output rate of the color frame data and the general frame refresh rate. The data conversion circuit of the present disclosure itself does not receive input clock and does not generate reference clock to adjust the output rate of the color frame data. When the input data received by the data conversion circuit changes/varies, before the color frame data of a new frame is fully received by the color display panel/module, the color display panel/module displays the color frame of the current color frame data, and until/after the color frame data of the new color frame is fully received by the color display panel/module, the new color frame is displayed. Therefore, the color display panel/module changes the color frame being displayed with an interruptive manner/behavior. Although users would feel/see the discontinuity between frames with this practice of displaying, the main purpose of the black-and-white liquid crystal display or the pixel display in the conventional electronic device is to display information, and so user experience on dynamic or lagged frame quality is not a concern and would not need to be taken into consideration. In addition, the aforementioned practice of displaying is achievable with circuit components that have lower cost and lower processing speed, which in turn lowers the manufacturing cost for the data conversion circuit of the present disclosure, and so the cost of the data conversion circuit and the color display panel/module as a whole is far less than the current black-and-white liquid crystal display and the pixel display.

Figure 3:
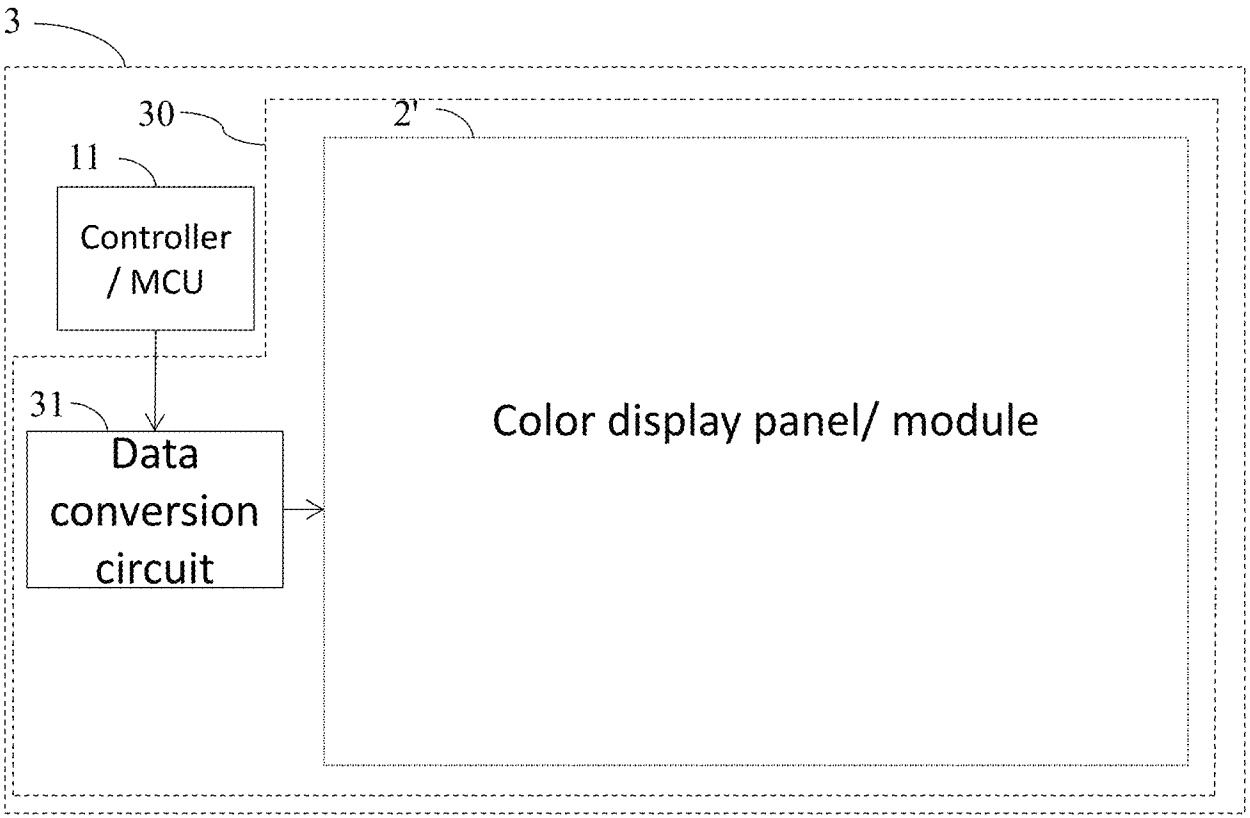
FIG. 3 is a schematic diagram showing a data conversion circuit according to an embodiment of the present disclosure is applied in an electronic device.

Now that the concept of the present disclosure has been stated, the details of each embodiment of the present disclosure will be described. Referring to FIG. 3, according to an embodiment of the present disclosure, an electronic device 3 includes a controller/MCU 11 and a color display device 30, wherein the controller/MCU 11 is electrically connected to the color display device 30. The controller/MCU 11 is used to output pixel signals of a black-and-white or grayscale frame (i.e. an input data of the black-and-white or grayscale frame which the controller/MCU 11 provides to the data conversion circuit 31) for driving a pixel display to display the black-and-white or grayscale frame corresponding to the pixel signals.

The color display device 30 includes a data conversion circuit 31 and a color display panel/module 2', wherein the data conversion circuit 31 is electrically connected to the color display panel/module 2'.

The data conversion circuit 31 includes a plurality of circuit components electrically connected to one another for forming a data conversion unit, and the data conversion circuit is used to perform the functions of the data conversion circuit 31 in the present disclosure. Moreover, the data conversion circuit 31 and the color display panel/module 2' are integrated together in the embodiment, but the present disclosure is not limited thereby, the data conversion circuit 31 can also be an independent element acting as an intermediary interface between the color display panel/module 2' and the controller/MCU 11.

The input data output by the controller/MCU 11 to the data conversion circuit 31 is a plurality of pixel signals of a black-and-white or grayscale frame, the data conversion circuit converts the gamut of the pixel signals of the black-and-white or grayscale frame to obtain a corresponding color frame data (for example, a transformation of gamut from grayscale to color is performed). The plurality of circuit components of the data conversion circuit 31 can be configured into a computing unit to achieve the gamut conversion of the pixel signals of the black-and-white or grayscale frame as mentioned above. Furthermore, the data conversion circuit 31 itself does not receive input clock or generate reference clock to adjust the output rate of the color frame data to make the output rate of the color frame data correspond to the general frame refresh rate (i.e. the data conversion circuit 31 has no drivers for receiving the input clock and generating the reference clock), and thus when the input data received by the data conversion circuit 31 changes/varies in content, the color display panel/module 2' changes the displaying color frame through the interruptive manner.

In view of above, the present disclosure provides a data conversion circuit that is capable of converting black-and-white or grayscale frames that were displayed on a convention electronic device to be displayable on a color display panel/module. Therefore, when the pixel display or the black-and-white liquid crystal display of the convention electronic device is broken or has a malfunction, the data conversion circuit can be used as an intermediary interface to allow the current color display panel/module, like a color liquid crystal display, to replace the broken or damaged pixel display or black-and-white liquid crystal display, and thereby reducing the maintenance cost. In addition, the data conversion circuit can be integrated with the current color display panel/module to form a color display device and directly replace the pixel display or black-and-white liquid crystal display of the convention electronic device. Moreover, by integrating the controller/MCU of the conventional electronic device (such as, a home appliance, a machine tool, a processing machine, a watch, a calculator, or other electronic device having a screen which can display or be operated by a user), the data conversion circuit of the present disclosure, and the current color display panel/module, a new electronic device thus formed has a reduced manufacturing cost.

The above disclosure is only the preferred embodiment of the present disclosure, and not used for limiting the scope of the present disclosure. All equivalent variations and modifications on the basis of shapes, structures, features and spirits described in claims of the present disclosure should be included in the claims of the present disclosure.

The invention claimed is:

1. A data conversion circuit for converting black-and-white or grayscale frames for a color display panel/module, the data conversion circuit comprising:

a data conversion unit for receiving an input data of the black-and-white or grayscale frame provided by a controller/MCU;

wherein the data conversion unit converts the input data into a color frame data to be provided to the color display panel/module, and no input clock or reference clock for adjusting an output rate of the color frame data is received or generated by the data conversion circuit;

wherein the data conversion circuit converts the gamut of the plurality of pixel signals of the black-and-white or grayscale frame from grayscale to color and generates the color frame data.

2. The data conversion circuit of claim 1, wherein the data conversion unit is a computing unit plurality formed by a plurality of circuit components.

3. The data conversion circuit of claim 1, wherein when the content of the input data sent to the data conversion circuit varies/changes, the color display panel/module changes the color frame displayed thereon by an interruptive manner.

4. A color display device comprising:

a color display panel/module; and a data conversion circuit electrically connected to the color display panel/module for converting black-and-white or grayscale frames for the color display panel/module, the data conversion circuit comprising a data conversion unit for receiving an input data of the black-and-white or grayscale frame from a controller/MCU, wherein the data conversion unit converts the input data into a color frame data to be provided to the color display panel/module and no input clock or reference clock for adjusting an output rate of the color frame data is received or generated by the data conversion circuit;

wherein the data conversion circuit converts the gamut of the plurality of pixel signals of the black-and-white or grayscale frame from grayscale to color and generates the color frame data.

5. The color display device of claim 4, wherein the data conversion unit is a computing unit formed by a plurality of circuit components.

6. The color display device of claim 4, wherein when the content of the input data sent to the data conversion circuit varies/changes, the color display panel/module changes the color frame displayed thereon by an interruptive manner.

7. An electronic device comprising:

a controller/MCU; a color display panel/module; and a data conversion circuit electrically connected to the color display panel/module and the controller/MCU for converting black-and-white or grayscale frames for the color display panel/module, the data conversion circuit comprising a data conversion unit for receiving an input data of the black-and-white or grayscale frame from the controller/MCU, wherein the data conversion unit converts the input data into a color frame data to be provided to the color display panel/module and no input clock or reference clock for adjusting an output rate of the color frame data is received or generated by the data conversion circuit;

wherein the data conversion circuit converts the gamut of the plurality of pixel signals of the black-and-white or grayscale frame from grayscale to color and generates the color frame data.

8. The electronic device of claim 7, wherein the data conversion unit is a computing unit formed by a plurality of circuit components.

9. The electronic device of claim 7, wherein the electronic device is a home appliance, a machine tool, a processing machine, a watch, calculator, or an electronic device having a screen which is able to display or be operated by a user.

10. The electronic device of claim 7, wherein when the content of the input data sent to the data conversion circuit varies/changes, the color display panel/module changes the color frame displayed thereon by an interruptive manner.

* * * * *